US006338197B1

(12) United States Patent
Shohara et al.

(10) Patent No.: US 6,338,197 B1
(45) **Date of Patent: *Jan. 15, 2002**

(54) METHOD OF MANUFACTURING MULTI-STAGE PULLEY

(75) Inventors: Hiroshi Shohara; Mitsunori Adachi, both of Toyohashi; Haruo Suzuki, Aichi-Pref.; Yasuji Kasuya, Okazaki; Tetuo Ohno, Oobu; Yasuo Tabuchi, Toyoake; Masahiro Kinoshita, Kariya; Shigeo Murata, Kobe, all of (JP)

(73) Assignees: Denso Corporation, Kariya; Nihon Spindle Mfg. Co., Ltd., Amagasaki, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,731

(22) Filed: Mar. 23, 1999

(30) Foreign Application Priority Data

Mar. 23, 1998 (JP) ..... 10-074494
Mar. 3, 1999 (JP) ..... 11-056121

(51) Int. Cl.[7] ..... B21K 1/42
(52) U.S. Cl. ..... 29/892.3; 72/110
(58) Field of Search ..... 29/892.3; 72/68, 72/110; 474/78, 168–170

(56) References Cited

U.S. PATENT DOCUMENTS 4,055,976 A * 11/1977 Kraft ..... 29/892.3

FOREIGN PATENT DOCUMENTS

| | | | | |
|---|---|---|---|---|
| EP | 0517572 A1 | * | 12/1992 | ..... 29/892.3 |
| EP | 0 552 776 A1 | | 1/1993 | |
| JP | 61-132238 | * | 6/1986 | ..... 29/892.2 |
| JP | 2-255237 | * | 10/1990 | ..... 29/892.3 |

* cited by examiner

*Primary Examiner*—P. W. Echols
(74) *Attorney, Agent, or Firm*—Harness, Dickey & Pierce, PLC

(57) ABSTRACT

The manufacturing cost of a multi-stage pulley is reduced without coaxially arranging a plurality of groove forming sections. While a portion between groove sections 103 is being pushed by a pushing roller 204, the groove sections 103 are successively formed. While a portion of workpiece W2 pushed by a groove forming roller 206 to form one groove section 103*a* and a portion of workpiece W2 pushed by a groove forming roller 207 to form the other groove section 103*b* are being shifted from each other in the circumferential direction, one groove section (103*a*) and the other groove section (103*b*) are simultaneously formed. Due to the foregoing, when the groove sections 103 are formed, it is possible to prevent the deformation of the groove section 103 and the groove section 103 which is adjacent to it. Accordingly, it is possible to enhance the yield of the multi-stage pulley 100 without coaxially arranging a plurality of groove forming sections. Therefore, the cost of manufacturing the multi-stage pulley 100 can be reduced.

5 Claims, 9 Drawing Sheets

METHOD OF MANUFACTURING MULTI-STAGE PULLEY

BACKGROUND OF THE INVENTION

1. Field of the Invention

The present invention relates to a method of manufacturing a multi-stage pulley having a plurality of groove sections with which a driving belt is engaged.

2. Description of the Related Art

Concerning the method of manufacturing a multi-stage pulley, for example, Japanese Unexamined Patent Publication No. 63-63544 discloses a method in which a workpiece used for manufacturing a multi-stage pulley is plastically deformed by a groove forming roller in which a plurality of groove forming sections are arranged coaxially and integrally with each other so that the groove sections can be formed.

SUMMARY OF THE INVENTION

Each groove section of a multi-stage pulley is formed when a workpiece of the multi-stage pulley is plastically deformed by a groove-forming roller. Therefore, a shearing force is given to an end of the groove forming roller according to the plastic deformation. For the above reasons, there is a high possibility that the groove-forming roller is damaged in the process of forming the grooves by the method disclosed in the above patent publication.

In order to solve the above problems, the present inventors made investigation into a means for successively forming a plurality of grooves at different positions so as to prevent the groove-forming roller from being damaged. As a result of the investigation, it was possible to prevent the groove-forming roller from being damaged, however, the following new problems were encountered. Unlike the case described in the above patent publication in which formation of a plurality of grooves is conducted by a groove-forming roller having a plurality of groove-forming sections which are coaxially arranged, it is impossible to simultaneously form the plurality of groove sections by the means which was attempted in the investigation. Accordingly, a groove, which is adjacent to a groove being formed now, is deformed in the process of groove formation.

Due to the foregoing, the yield of manufacturing the multi-stage pulleys is deteriorated, and the manufacturing cost is raised.

In view of the above circumstances, the present invention has been accomplished. It is an object of the present invention to provide a method of manufacturing a multi-stage pulley by which the manufacturing cost can be reduced without coaxially arranging a plurality of groove forming sections.

DESCRIPTION OF THE PREFERRED EMBODIMENTS

Figure 1:
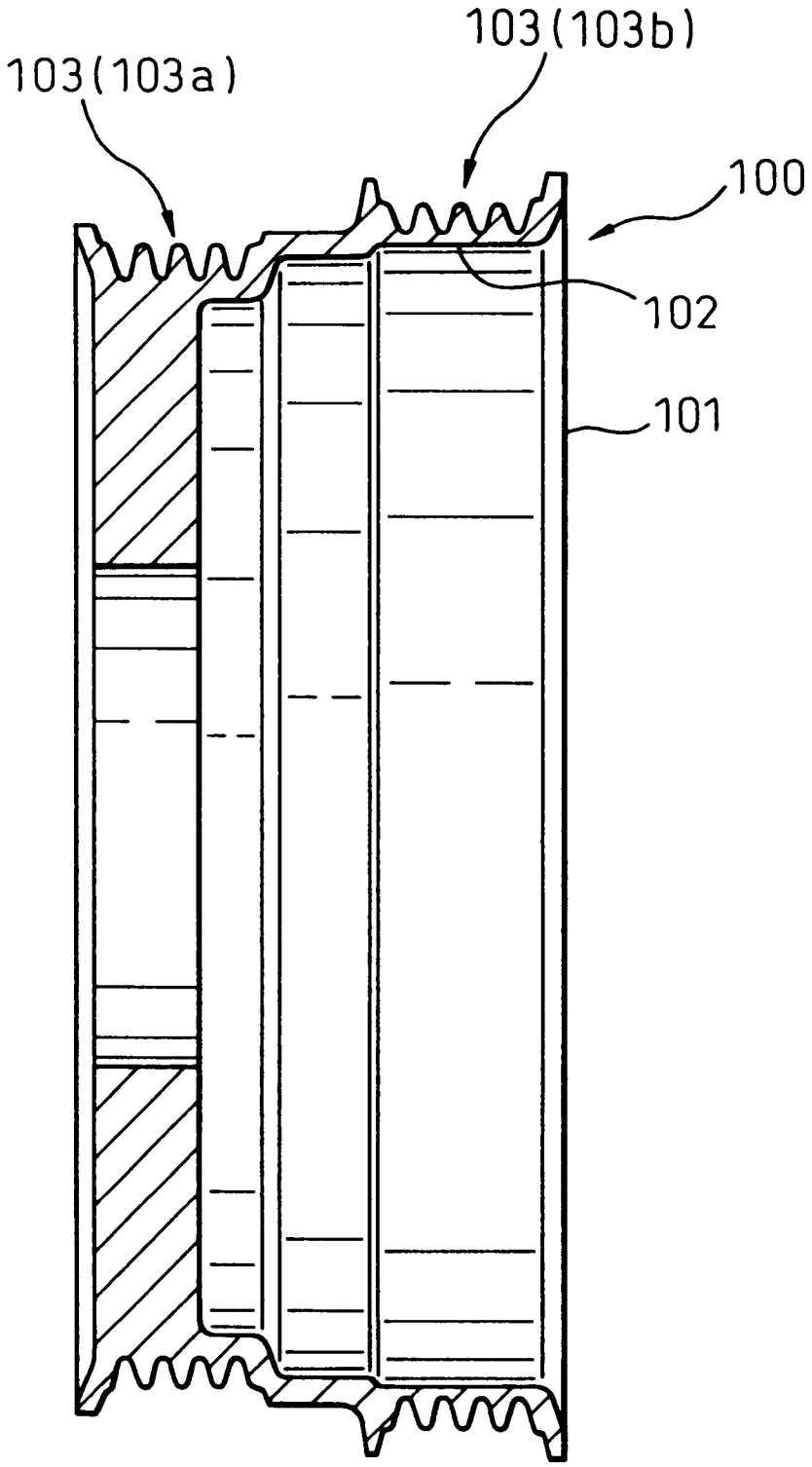
FIG. 1 is a cross-sectional view of a multi-stage pulley of the present invention.

In order to accomplish the above object, the following technical means are provided by the present invention.

According to the described invention, a plurality of groove sections (103) are formed while a space between portions of the circumferential outer wall section of the substantially cup-shaped workpiece (W2), corresponding to the groove sections (103), is being pushed. A portion of workpiece (W2) pushed by the groove forming roller (206, 207) in the case of forming one groove section (103*a*) and a portion of workpiece (W2) pushed by the groove forming roller (206, 207) in the case of forming the other groove section (103*b*) are shifted from each other in the circumferential direction of workpiece (W2), and one groove section (103*a*) and the other groove section (103*b*) are simultaneously formed.

Due to the foregoing, it is possible to suppress the deformation of the groove sections (103) which are being successively formed one by one and also suppress the deformation of the groove sections (103*a*, 103*b*), which are adjacent to the groove sections (103). Therefore, it is possible to enhance the yield of manufacturing the multi-stage pulleys (100) without using a groove forming roller in which a plurality of groove forming sections are coaxially arranged. Therefore, it is possible to reduce the cost of manufacturing the multi-stage pulley (100).

It is possible to enhance the dimensional accuracy of the multi-stage pulley (100) and to prevent the groove-forming roller (206, 207) from being damaged. It is also possible to enhance the yield of manufacturing the multi-stage pulley (100).

In this connection, as described in the present invention, workpiece (W2) may be formed by conducting spinning on a sheet-shaped workpiece (W1) to manufacture a multi-stage pulley.

In this connection, reference numerals in parentheses correspond to the specific means of the embodiments described later.

EXAMPLE

FIG. 1 is a cross-sectional view of a multi-stage pulley 100 manufactured by the method of manufacturing a multi-stage pulley of this embodiment. This multi-stage pulley 100 includes: a circumferential outer wall section (rim section) 102 of a substantially cup-shaped pulley body 101; and two groove sections 103*a*, 103*b* with which a driving belt (not shown) is engaged, wherein the circumferential outer wall section 102 and the two groove sections 103*a*, 103*b* are integrated into one body. These two groove sections 103*a*, 103*b* will be referred to as a groove section 103 in this specification hereinafter.

The method of manufacturing the multi-stage pulley 100 will be described below according to the manufacturing processes.

Figure 2:
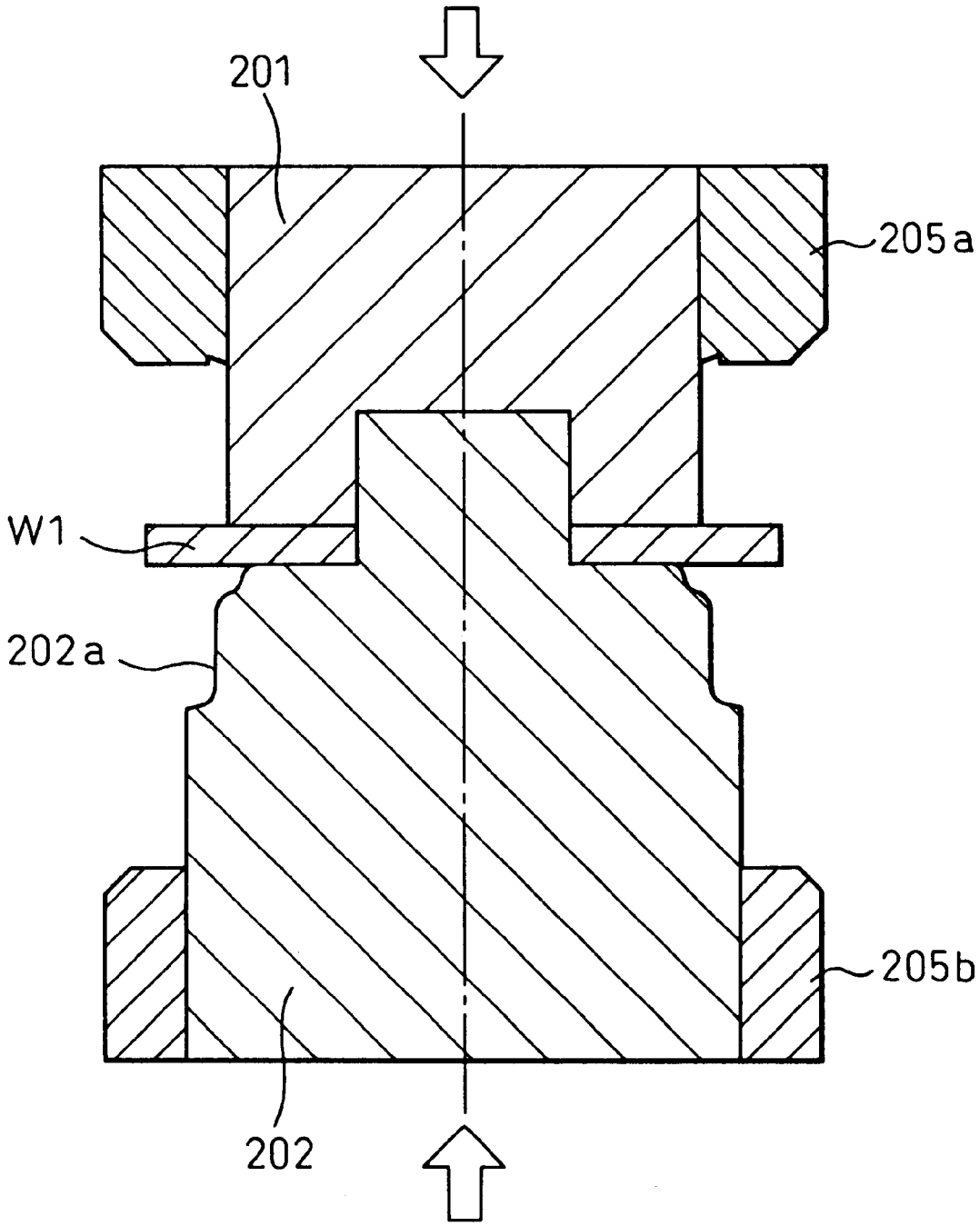
FIG. 2 is a schematic illustration showing a model of a chucking process.

There is provided a disk-shaped workpiece W1 to manufacture a multi-stage pulley. In this embodiment, workpiece W1 is made of iron. As shown in FIG. 2, a first die 201 and a second die 202 push workpiece W1 from both sides in the thickness direction, so that workpiece W1 to manufacture a multi-stage pulley can be chucked. This process is referred to as a chucking process.

In this connection, on an outer circumference of the second die 202, there is provided a step portion 202*a* which is formed along an inner circumference of the rim section 102 of the multi-stage pulley 100.

Figure 3:
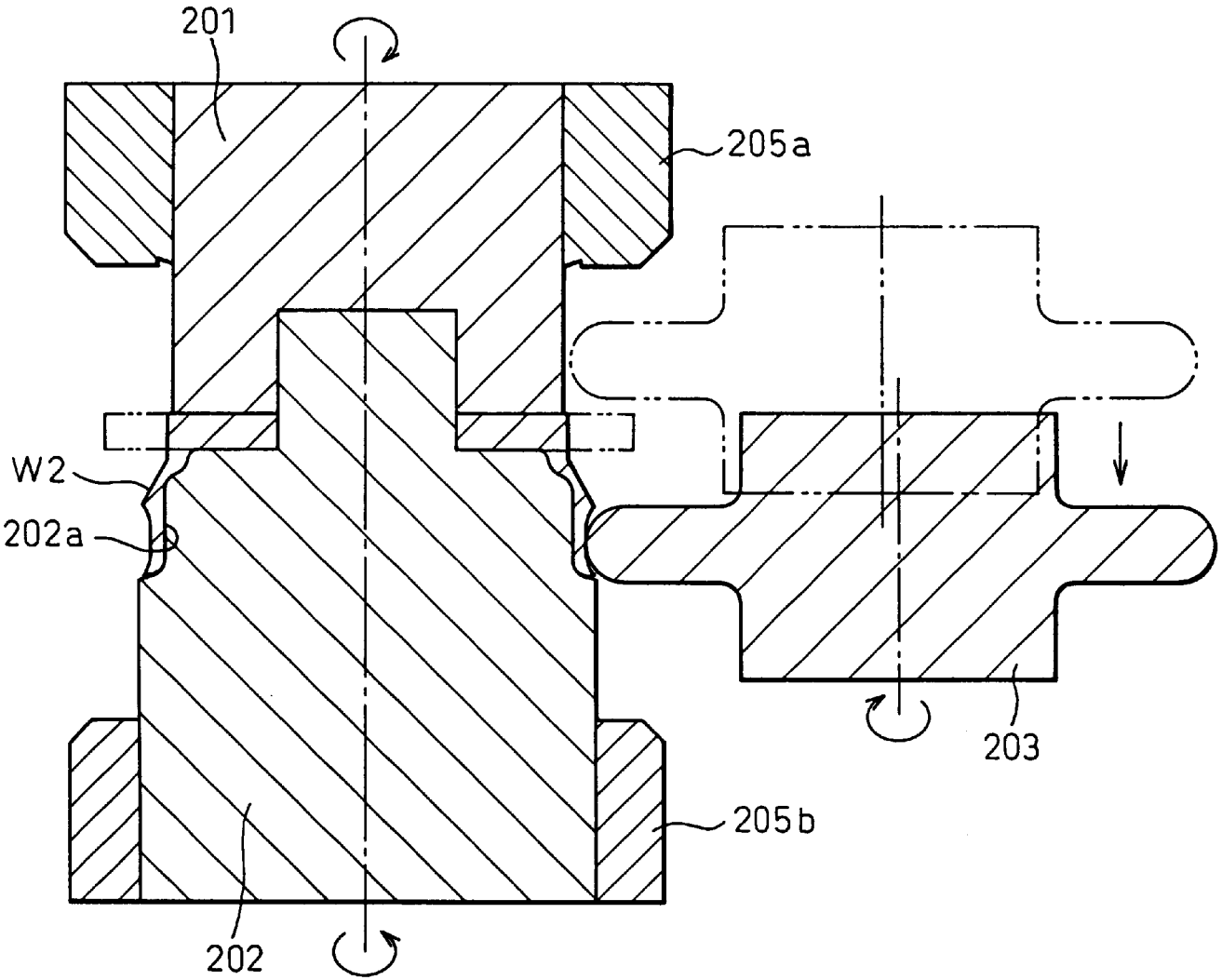
FIG. 3 is a schematic illustration showing a model of a spinning process.

Next, as shown in FIG. 3, while a portion of workpiece W1 which is pushed by both dies 201, 203 is used as a bottom portion, and while a spinning roller 203 is being rotated together with both dies 201, 202 and workpiece W1, the spinning roller 203 is moved from the first die 201 side to the second die 202 side. In this way, spinning is conducted on workpiece W1 so that workpiece W1 can be formed into a substantial cup shape along the step portion 202*a*. This process is referred to as a spinning process.

Figure 4:
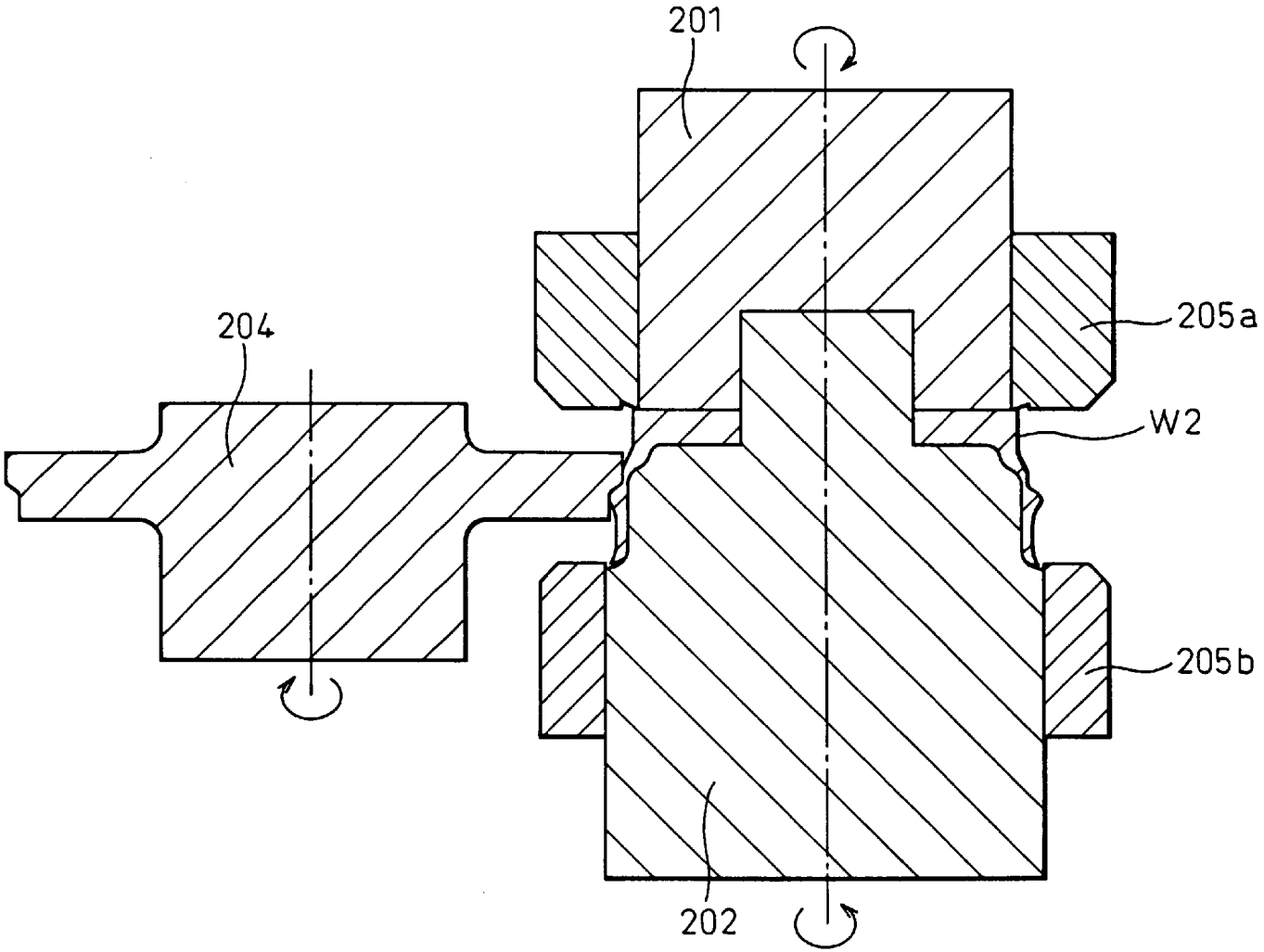
FIG. 4 is a schematic illustration showing a model of an annular groove forming process.

Next, as shown in FIG. 4, a pushing roller 204 to push a space between portions corresponding to the groove sections 103 is made to come into contact with workpiece W2 formed in the spinning process. This process is referred to as a pushing roller contact process. At the same time, in order to prevent workpiece W2 from being plastically deformed unnecessarily in the axial direction of the multi-stage pulley 100 (both dies 201, 202), workpiece holding rings 205*a*, 205*b* are moved toward workpiece W2.

Figure 5:
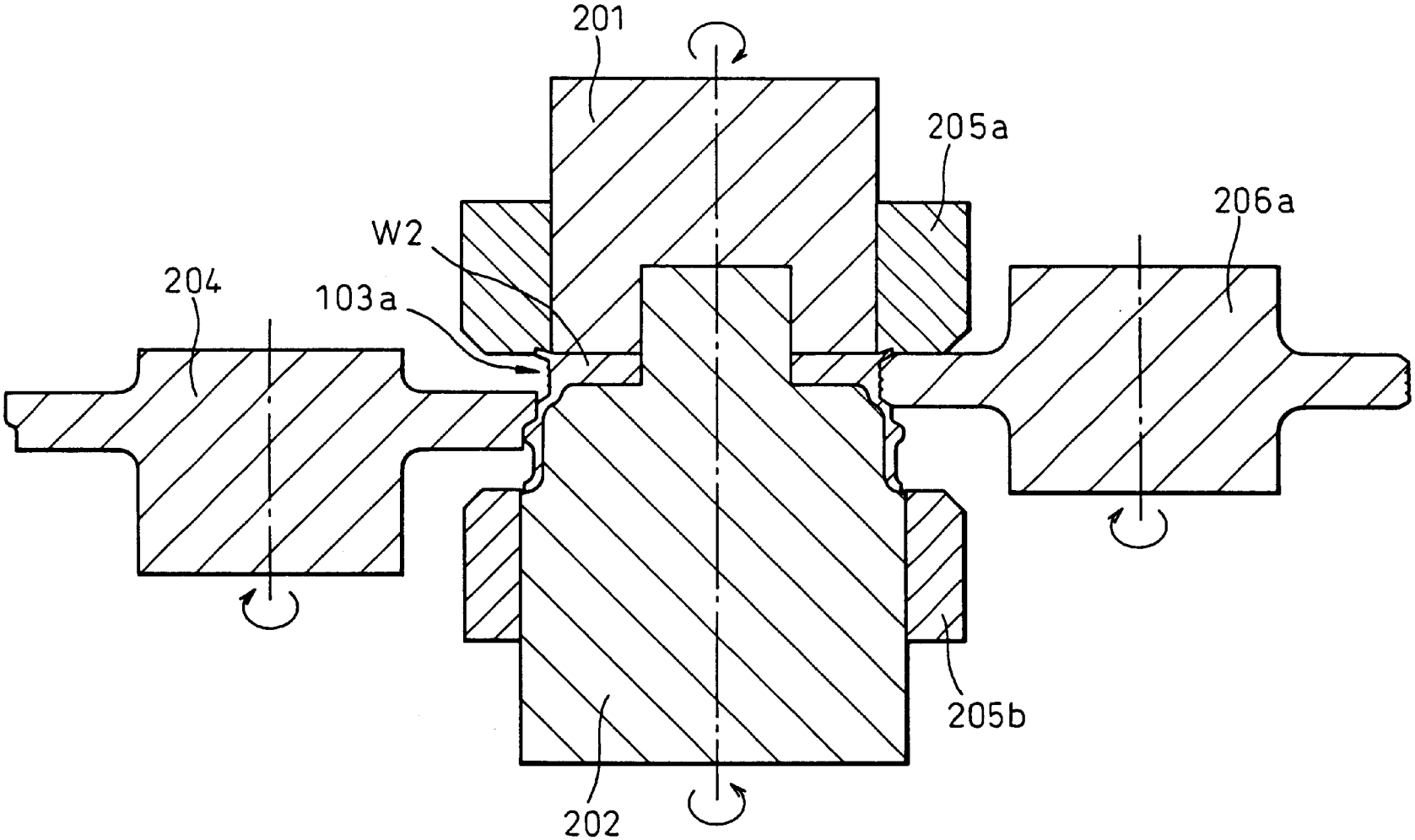
FIGS. 5 and 6 are schematic illustrations showing a model of a first groove forming process on section A—A in FIG. 9.
Figure 6:
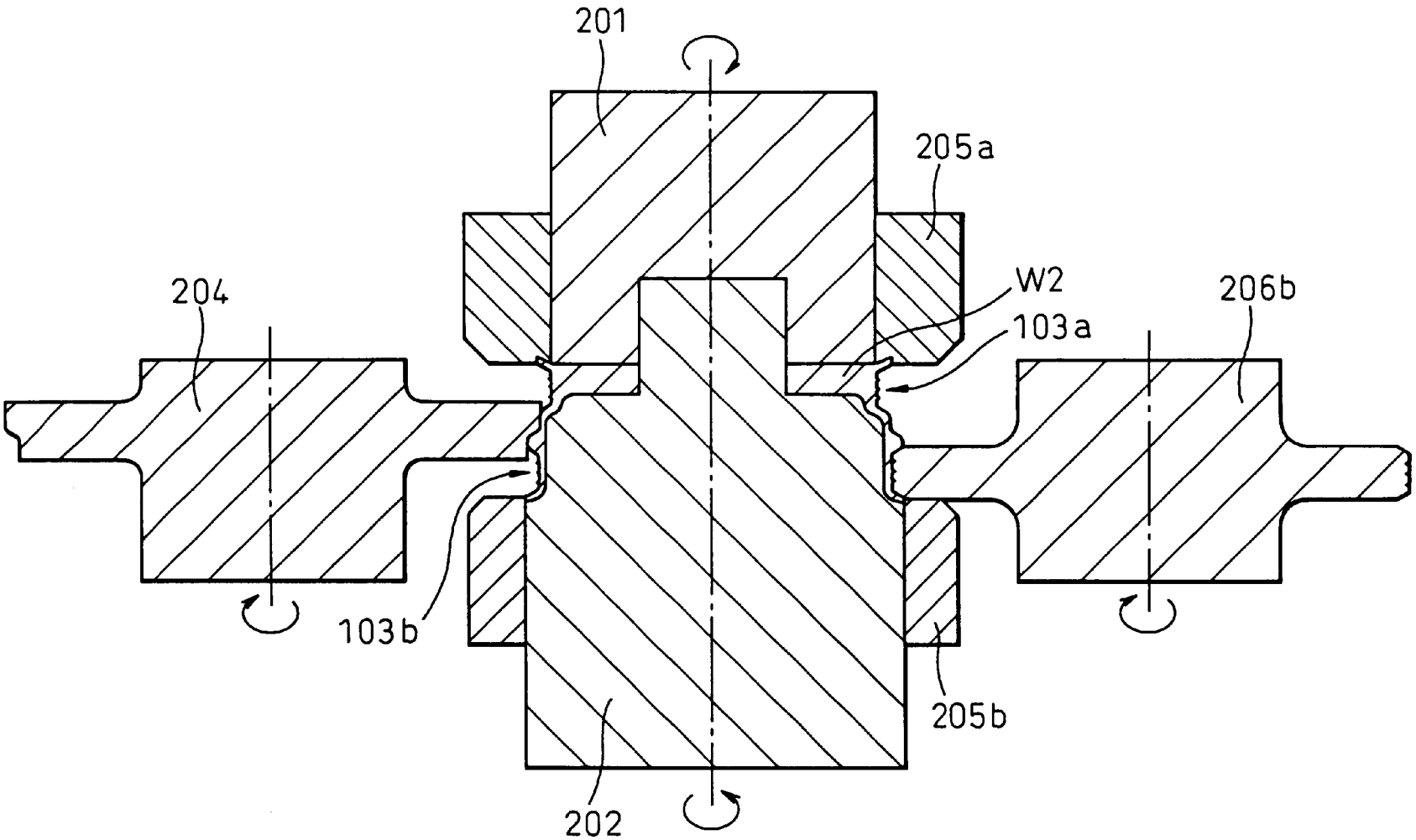

As shown in FIGS. 5 and 6, while the pushing roller 204 is being pushed against workpiece W2, preliminary groove forming rollers 206*a*, 206*b* are simultaneously pushed against the circumferential outer wall section of workpiece W2, so that two groove sections 103 can be successively formed one by one. This process is referred to as a first groove forming process. The preliminary groove forming roller 206*a* pushes a portion which will become one groove section 103*a* shown in FIG. 1, and the preliminary groove forming roller 206*b* pushes a portion which will become the other groove section 103*b* shown in FIG. 1.

Figure 7:
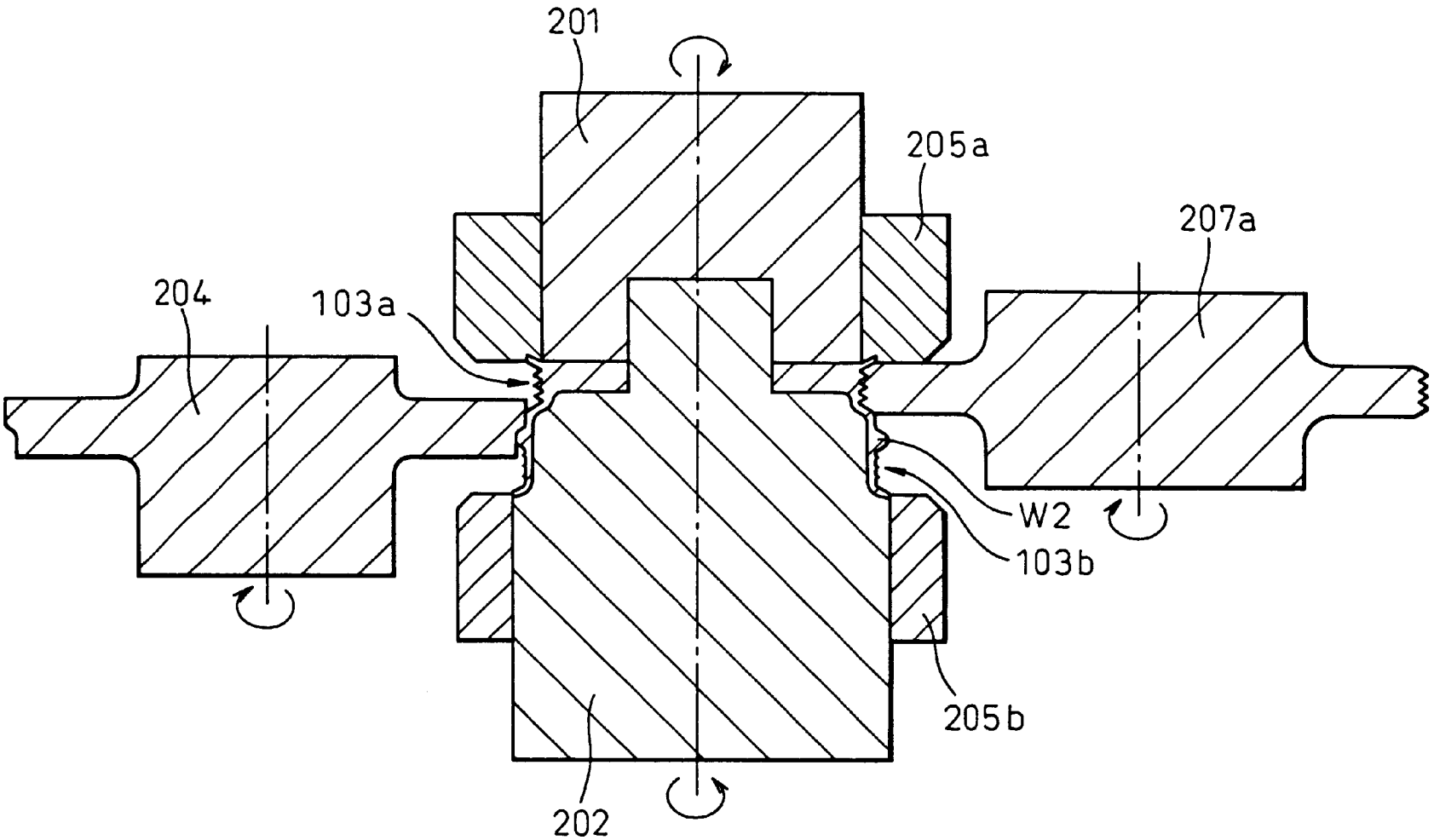
FIGS. 7 and 8 are schematic illustrations showing a model of a second groove forming process on section B—B in FIG. 9.
Figure 8:
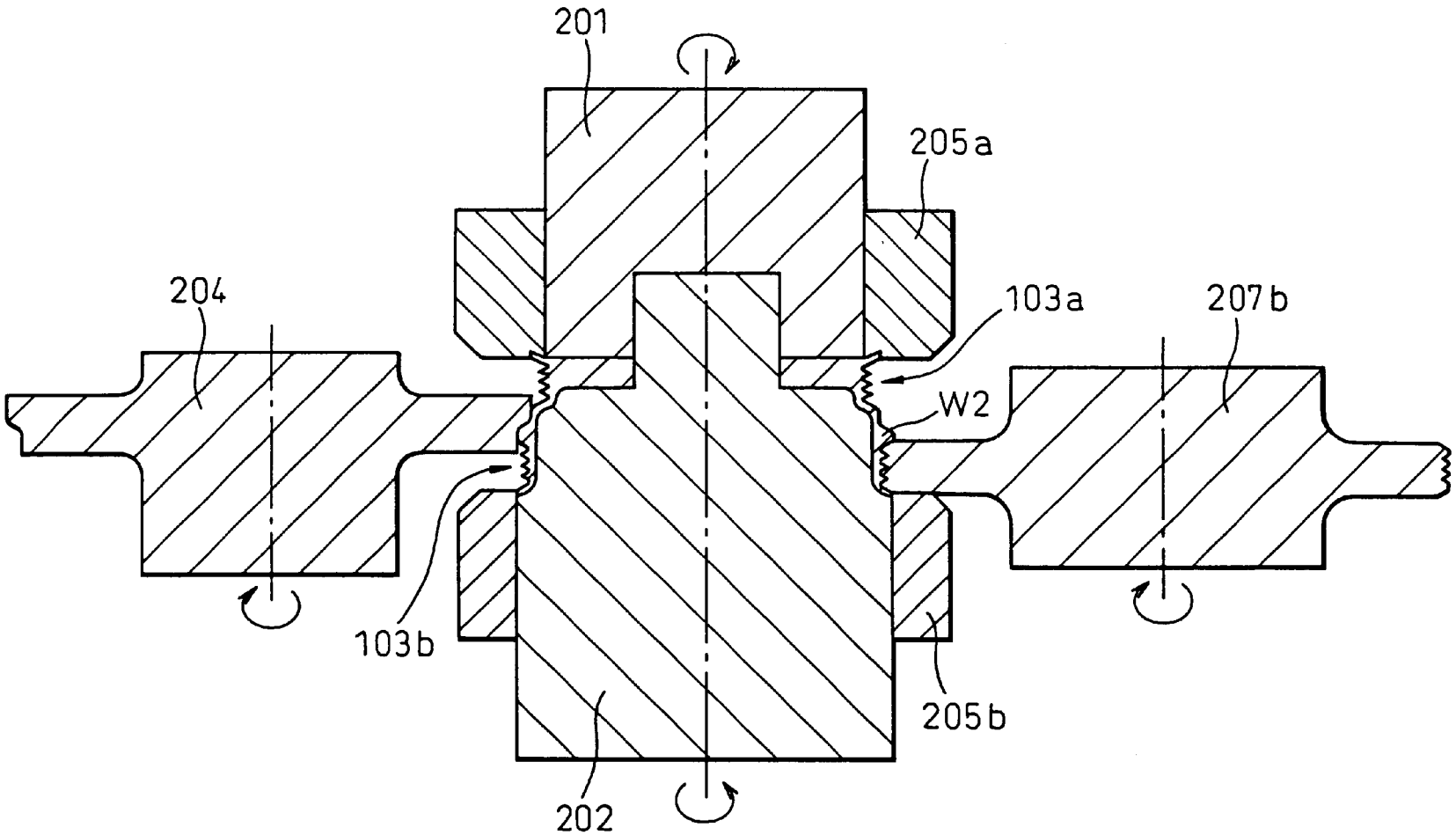

Next, as shown in FIGS. 7 and 8, in the same manner as that of the first groove forming process, while the pushing roller 204 is being pushed against workpiece W2, finishing groove forming rollers 207*a*, 207*b* are simultaneously pushed against the circumferential outer wall section of workpiece W2, so that two groove sections 103 can be successively finished one by one. This process is referred to as a second groove forming process. In this case, the finishing groove forming roller 207*a* pushes a portion which will become one groove section 103*a*, and the finishing groove forming roller 207*b* pushes a portion which will become the other groove section 103*b*.

Figure 9:
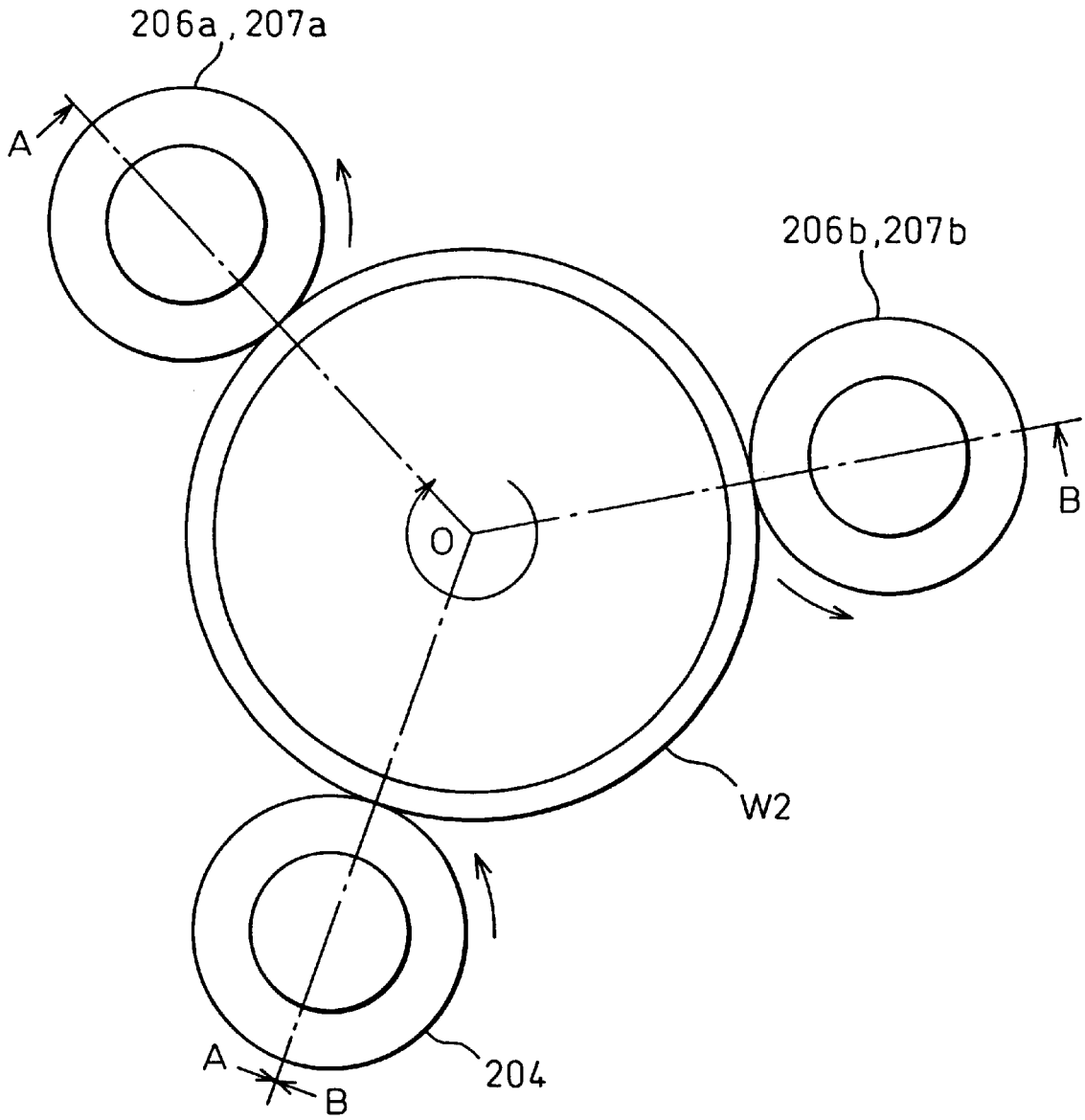
FIG. 9 is a schematic illustration showing a method of manufacturing a multi-stage pulley.

At this time, the first and the second groove forming processes are conducted as follows. Without distinction of the preliminary groove forming process and the finishing groove forming process, as shown in FIG. 9, the first and the second groove forming processes are conducted so that portions, at which both groove forming rollers 206*a*, 206*b*, 207*a*, 207*b* push workpiece W2 in the case of forming one groove section 103*a* (shown in FIG. 1), and portions, at which both groove forming rollers 206*a*, 206*b*, 207*a*, 207*b* push workpiece W2 in the case of forming the other groove section 103*b* (shown in FIG. 1), can be shifted from each other in the circumferential direction and so that one groove section 103*a* and the other groove section 103*b* can be simultaneously formed.

Next, characteristics of this embodiment will be described below.

According to the method of manufacturing the multi-spate pulley 100 of this embodiment, the groove section 103 is formed under the condition that a portion between the groove sections 103 is pushed by the pushing roller 204. Accordingly, it is possible to prevent the groove section 103, which is being formed, and the groove section 103, which is adjacent to it, being deformed when the groove sections 103 are successively formed one by one. Accordingly, it is possible to enhance the dimensional accuracy of the finished multi-stage pulley 100 and also it is possible to enhance the yield of manufacturing the multi-stage pulley 100 without using a groove forming roller in which a plurality of groove forming sections are coaxially arranged. Therefore, it is possible to reduce the cost of manufacturing the multi-stage pulley 100.

As shown in FIGS. 6 and 7, the circumferential outer wall section (rim section 102) of workpiece W2 is prevented from being unnecessarily plastically deformed, by the engaging sections formed in both workpiece holding rings 205*a*, 205*b*. Therefore, it is possible to enhance the dimensional accuracy of the finished multi-stage pulley 100. As a result, the yield of the multi-stage pulley 100 can be enhanced. Consequently, the cost of manufacturing the multi-stage pulley 100 can be reduced.

In this embodiment, the first die 201 and the second die 202, which were used in the chucking process, are used even in the second groove forming process (final process) for chucking. Therefore, unlike the method disclosed in Japanese Unexamined Patent Publication No. 61-132238, it is unnecessary to change the die for chucking in each process. Accordingly, an amount of equipment investment for the die can be reduced, and the cost of manufacturing the multi-stage pulley 100 can be reduced.

In this connection, as a result of the investigation made by the present inventors, the following facts were confirmed. In the first and the second groove forming processes, unless a portion, in which workpiece W2 is pushed when one groove section 103*a* is formed by both groove forming rollers 206, 207, and a portion, in which workpiece W2 is pushed when the other groove section 103b is formed, are shifted from each other in the circumferential direction, and unless one groove section 103*a* and the other groove section 103*b* are simultaneously formed, an amount of deformation of workpiece W is increased, and an amount of plastic fluidity of material is increased. Accordingly, there is a high possibility that the tools (both groove forming rollers 206, 207) are damaged.

According to this embodiment, while the tools (both groove forming rollers 206, 207) can be prevented from being damaged, the dimensional accuracy of the finished multi-stage pulley 100 and the yield of manufacturing the multi-stage pulley 100 can be enhanced.

In this embodiment, the substantially cup-shaped workpiece W2 is formed by means of spinning, however, it should be noted that the present invention is not limited to the above specific embodiment. The substantially cup-shaped workpiece W2 may be formed by pressing a sheet material or a pipe material.

What is claimed is:

1. A method of manufacturing a multi-stage pulley (100) having a plurality of groove sections (103) integrally formed with each other and adapted for engagement with driving belts, the method comprising:

a preliminary groove forming process in which, while a pushing roller (204) is pushed against a substantially cup-shaped work-piece (W2), a first space between portions of a circumferential outer wall section of the substantially cup-shaped work-piece (W2) corresponding to a first groove section (103*a*) of the plurality of groove sections (103) is pushed by a first preliminary groove-forming roller (206*a*) and a second space between portions of the circumferential outer wall section of the substantially cup-shaped work-piece (W2) corresponding to a second groove section (103*b*) of the plurality of groove sections (103) is pushed by a second preliminary groove forming roller (206*b*) and so as to preform both first and second groove sections (103*a*, 103*b*) of the plurality of groove sections (103); and a groove forming finishing process in which, while the pushing roller (204) is pushed against the substantially cup-shaped work-piece (W2), the first space between portions of the circumferential outer wall section of the substantially cup-shaped work-piece (W2) corresponding to the first groove section (103*a*) of the plurality of groove sections (103) is pushed by a first finishing-groove forming roller (207*a*) and the second space between portions of the circumferential outer wall section of the substantially cup-shaped work-piece (W2) corresponding to the second groove section (103*b*) of the plurality of grooves sections (103) is pushed by a second finishing groove-forming roller (207*b*) so as to finish both first and second groove sections (103*a*, 103*b*) of the plurality of groove sections (103);

wherein, in the groove forming finishing process, the first and second finishing groove-forming rollers (207*a*, 207*b*) are arranged so that portions of the substantially cup-shaped work-piece (W2) corresponding to both first and second groove sections (103*a*, 103*b*) of the plurality of grooves sections (103) to be pushed in the case of forming and finishing the first groove section (103*a*) and the second groove section (103*b*) can be shifted from each other in the circumferential direction of the substantially cup-shaped work-piece (W2), and the first groove section (103*a*) and the second groove section (103*b*) are simultaneously formed and finished.

2. The method of manufacturing a multi-stage pulley according to claim 1, further comprising:

a chucking process for chucking a sheet-shaped work-piece (W1) of the multi-stage pulley by pushing dies (201, 202) against the sheet-shaped work-piece (W1) from both sides of the sheet-shaped work-piece (W1) in the thickness direction; and a spinning process for forming the substantially cup-shaped work-piece (W2) by conducting spinning while a portion of the sheet-shaped work-piece (W1) pushed by the pushing dies (201, 202) is used as a bottom portion, wherein the chucking process and the spinning process are conducted before both groove forming processes.

3. The method of manufacturing a multi-stage pulley according to claim 3, further comprising:

in the preliminary groove-forming process, the preliminary groove-forming rollers (206*a*, 206*b*) are arranged so that portions of the substantially cup-shaped work-piece (W2) corresponding to both the first and second groove sections (103*a*, 103*b*) of the plurality of grooves sections (103) to be pushed in the case of forming and finishing the first groove section (103*a*) and the second groove section (103*b*) are shifted from each other in the circumferential direction of the substantially cup-shaped work-piece (W2), and the first groove section (103*a*) and the second groove section (103*b*) are simultaneously formed.

4. A method of manufacturing a unitary multi-stage pulley having first and second groove sections, said method comprising:

pushing a pushing roller against an outer wall of a cup-shaped work-piece a first time;

pushing a first preliminary groove forming roller against the outer wall of the cup-shaped work-piece to form a first preliminary groove;

pushing a second preliminary groove forming roller against the outer wall of the cup-shaped work-piece to form a second preliminary groove;

pushing the pushing roller against the outer wall of the cup-shaped work-piece a second time;

pushing a first finishing groove roller against said first preliminary groove to finish said first groove section;

pushing a second finishing groove roller against said second preliminary groove to finish said second groove section; wherein said step of pushing the pushing roller the second time, said step of pushing the first finishing groove roller and said step of pushing the second preliminary groove roller are performed simultaneously.

5. The method of manufacturing the unitary multi-stage pulley according to claim 4, wherein:

said step of pushing the pushing roller the first time, said step of pushing the first preliminary groove forming roller and said step of pushing the second preliminary groove forming roller are performed simultaneously.

* * * * *

UNITED STATES PATENT AND TRADEMARK OFFICE

CERTIFICATE OF CORRECTION

PATENT NO. : 6,338,197 B1
DATED : January 15, 2002
INVENTOR(S) : Hiroshi Shohara et al.

It is certified that error appears in the above-identified patent and that said Letters Patent is hereby corrected as shown below:

Title page,
Item [56], References Cited, FOREIGN PATENT DOCUMENTS, list:
-- JP 63-63544 3/1988
JP 9-174189 7/1997 --

Column 6,
Line 4, "claim 3" should be -- claim 1 --

Signed and Sealed this

Twenty-sixth Day of November, 2002

*Attest:*

*Attesting Officer*

JAMES E. ROGAN
*Director of the United States Patent and Trademark Office*